US010287878B2

(12) United States Patent
Spoerker

(10) Patent No.: US 10,287,878 B2
(45) Date of Patent: May 14, 2019

(54) AUTOMATIC PUMPING CONTROL FOR LEAK-OFF TESTS

(71) Applicant: Saudi Arabian Oil Company, Dhahran (SA)

(72) Inventor: Hermann F. Spoerker, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 248 days.

(21) Appl. No.: 15/180,839

(22) Filed: Jun. 13, 2016

(65) Prior Publication Data

US 2017/0356291 A1 Dec. 14, 2017

(51) Int. Cl.

| | |
|---|---|
| ***E21B 49/00*** | (2006.01) |
| ***E21B 47/06*** | (2012.01) |
| ***E21B 47/10*** | (2012.01) |
| ***E21B 34/06*** | (2006.01) |
| ***E21B 47/12*** | (2012.01) |

(52) U.S. Cl.
CPC ..... *E21B 49/008* (2013.01); *E21B 34/06* (2013.01); *E21B 47/06* (2013.01); *E21B 47/1025* (2013.01); *E21B 47/12* (2013.01)

(58) Field of Classification Search
CPC ..... E21B 49/008; E21B 47/12; E21B 47/06; E21B 47/1025; E21B 34/06
See application file for complete search history.

(56) References Cited

U.S. PATENT DOCUMENTS

| | | | | |
|---|---|---|---|---|
| 6,076,046 | A | 6/2000 | Vasudevan et al. | |
| 6,378,363 | B1 | 4/2002 | Hache et al. | |
| 6,705,398 | B2 | 3/2004 | Wang | |
| 8,606,524 | B2 | 12/2013 | Soliman et al. | |
| 2009/0276156 | A1 * | 11/2009 | Kragas | E21B 43/12 702/6 |
| 2013/0186688 | A1 * | 7/2013 | Rasmus | E21B 47/06 175/48 |

FOREIGN PATENT DOCUMENTS

| | | |
|---|---|---|
| GB | 2347447 | 9/2000 |

OTHER PUBLICATIONS

Postler (SPE/IADC 37589—Pressure Integrity Test Interpretation, 1997) (Year: 1997).*

(Continued)

*Primary Examiner* — George S Gray
(74) *Attorney, Agent, or Firm* — Fish & Richardson P.C.

(57) ABSTRACT

In some aspects, injection fluid is flowed into a closed wellbore in a subterranean region. Wellbore pressure in response to flowing the injection fluid into the closed wellbore is measured. A plot representing a wellbore pressure in response to cumulative injection fluid volumes is substantially linear is determined. After determining the plot is linear, a first injection fluid pressure measured in response to flowing the injection fluid deviates from the substantially linear plot by a first variance greater than a threshold variance is determined. A second injection fluid pressure measured in response to flowing the injection fluid deviates from the substantially linear plot by a second variance greater than the threshold variance is determined. In response to the above two determinations, flow of injection fluid into the closed wellbore is stopped.

18 Claims, 4 Drawing Sheets

(56) References Cited

OTHER PUBLICATIONS

Allerstorfer, "Investigation of the 'Plastic-Behavior' Region in Leak-Off Tests," Master Thesis, Department of Mineral Resources and Petroleum Engineering, Leoben, Austria, Oct. 2011; 163 pages.
Moronkeji et al., "Calibration, Repeatability, and Interpretation of In-Situ Tectonic Stress Measurements from Wireline Straddle Packer MicroFrac Testing: Case Study of an Onshore Field in the UAE," Search and Discovery Article No. 41635, Jun. 29, 2015; 17 pages.
Bale et al., "Comprehensive Mini-Frac Testing in the Gullfaks Field as a Tool for Characterization of Reservoir Structure and Rock Mechanics," International Petroleum Technology Conference (IPTC 11968), Kuala Lumpur, Malaysia, Dec. 3-5, 2008; 18 pages.
PetroWiki, "Formation integrity test," published by SPE International, 2 pages, <http://petrowiki.org/Formation_integrity_test>.
"What are the differences between Formation Integrity Test (FIT) and Leak Off Test (LOT).?" published by DrillingFormulas.com, Nov. 27, 2010; 1 page, <http://www.drillingformulas.com/what-are-the-differences-between-formation-integrity-test-fit-and-leak-off-test-lot/>.
Layne, "Analysis of Gas Research Institute Data Staged Field Experiment No. 1 in the Travis Peak Formation, East Texas," Technical Report, U.S. Department of Energy, Office of Fossil Energy, Morgantown Energy Technology Center, Sep. 1, 1988; 41 pages.
Smith et al., "ReAnalysis of the MWX Fracture Stimulation Data From the Paludal Zone of the Mesaverde Formation," Annual Report, U.S. Department of Energy, Office of Fossil Energy, Morgantown Energy Technology Center, Nov. 1988; 164 pages.
Nande, "Comparison of square root of time approach and statistical approach to minimize subjectivity in the determination of minimum in-situ stress," Master Thesis, Graduate School of the Missouri University of Science and Technology, 2013; 128 pages.
Yango, "Characterization of Filter Cake Buildup and Cleanup Under Dynamic Fluid Loss Conditions," Master Thesis, Office of Graduate Studies of Texas A&M University, Aug. 2011; 76 pages.
International Search Report and Written Opinion issued in International Application No. PCT/US2017/036697 dated Sep. 18, 2017; 13 pages.

* cited by examiner

AUTOMATIC PUMPING CONTROL FOR LEAK-OFF TESTS

TECHNICAL FIELD

This disclosure relates to testing leaks in a subterranean region, for example, a region from which hydrocarbons can be extracted.

BACKGROUND

Leak-off test (LOT) is a test to determine the strength or fracture pressure of a formation. During the LOT, the well is shut in and fluid is pumped into the wellbore to gradually increase the pressure that the formation experiences. At some pressure, fluid will enter the formation or leak off, either moving through permeable paths in the rock or by creating a space by fracturing the rock. The results of the LOT can indicate the maximum pressure or mud weight that may be applied to the well during drilling operations. However, if the pressure goes beyond the maximum pressure, the wellbore may be permanently damaged and the future pressure containment capability may decrease, requiring less pressure to open the fractures back up again. Risks and challenges exist for performing LOTs.

SUMMARY

This disclosure relates to automatic pumping control for a leak-off test (LOT) of a subterranean region.

In some aspects, one innovative aspect of the subject matter described here can be implemented as a method. The method includes flowing injection fluid into a closed wellbore in a subterranean region; measuring wellbore pressure in response to flowing the injection fluid into the closed wellbore; determining that a plot representing a wellbore pressure in response to cumulative injection fluid volumes is substantially linear; after determining that the plot is linear, determining that a first injection fluid pressure measured in response to flowing the injection fluid into the wellbore deviates from the substantially linear plot by a first variance greater than a threshold variance; determining that a second injection fluid pressure measured in response to flowing the injection fluid into the wellbore after measuring the first injection fluid pressure deviates from the substantially linear plot by a second variance greater than the threshold variance; and in response to determining that the first injection fluid pressure deviates from the substantially linear plot by the first variance greater than a threshold variance and determining that the second injection fluid pressure deviates from the substantially linear plot by the second variance greater than the threshold variance, stopping flow of injection fluid into the closed wellbore.

This, and other aspects, can include one or more of the following features. In some aspects, the method further includes generating the plot representing a wellbore pressure in response to cumulative injection fluid volumes based on linear regression.

In some aspects, determining that a first injection fluid pressure measured in response to flowing the injection fluid into the wellbore deviates from the substantially linear plot by a first variance greater than a threshold variance includes determining a first regression line computed based on the first injection fluid pressure measured in response to flowing the injection fluid into the wellbore; and determining that the first regression line deviates from the substantially linear plot by the first variance greater than a threshold variance.

In some aspects, the first variance includes a variance in slopes between the first regression line and the substantially linear plot.

In some aspects, determining that a second injection fluid pressure measured in response to flowing the injection fluid into the wellbore after measuring the first injection fluid pressure deviates from the substantially linear plot by a second variance greater than the threshold variance includes determining a second regression line computed based on the second injection fluid pressure measured after measuring the first injection fluid pressure; and determining that the second regression line deviates from the substantially linear plot by the second variance greater than the threshold variance.

In some aspects, the second variance includes a variance in slopes between the second regression line and the substantially linear plot.

Another innovative aspect of the subject matter described here can be implemented as another method. The method includes: receiving, by operation of data processing apparatus, a number of pressures measured at a corresponding number of injection fluid volumes pumped into a closed wellbore in a subterranean region; determining, by operation of the data processing apparatus, a base slope of a change in the pressure in the wellbore with respect to a change in the number of injection fluid volumes, wherein the base slope represents a linear increase in pressure in the wellbore in response to continued pumping of injection fluid into the wellbore; after receiving the number of pressures at the corresponding number of injection fluid volumes, receiving, by operation of the data processing apparatus, a first pressure in the wellbore in response to a first volume of injection fluid pumped into the wellbore after pumping the number of injection fluid volumes; determining, by operation of the data processing apparatus, a first slope of a first pressure response versus injection volume line based on the first volume of injection fluid, the first pressure, the number of injection fluid volumes and the number of pressures; determining, by operation of the data processing apparatus, that a first variance between the first slope and the base slope is larger than a first threshold; receiving, by operation of the data processing apparatus, a second pressure in the wellbore in response to a second volume of injection fluid pumped into the wellbore after pumping the first injection fluid volume; determining, by operation of the data processing apparatus, a second slope of a second pressure response versus injection volume line based on the second volume of injection fluid, the second pressure, the first volume of injection fluid, the first pressure, the number of injection fluid volumes and the number of pressures; determining, by operation of the data processing apparatus, that a second variance between the second slope and the first slope is larger than a second threshold; and in response to determining that both the first difference is larger than the first threshold and the second variance is larger than the second threshold, sending, by operation of the data processing apparatus, an instruction to stop pumping additional injection fluid into the closed wellbore in the subterranean region.

This, and other aspects, can include one or more of the following features. In some aspects, the method further includes stopping pumping; and opening well valves to bleed off the pressure in the wellbore.

In some aspects, the method further includes determining a leak-off pressure based on the second pressure.

In some aspects, the first threshold and the second threshold are determined based on empirical leak off test data. In some aspects, the first pressure includes a first surface pumping pressure of the closed wellbore; and the second pressure includes a second surface pumping pressure of the closed wellbore.

In some aspects, the first volume of injection fluid pumped into the wellbore is different from the second volume of injection fluid pumped into the wellbore.

In some aspects, determining a first slope of a first pressure response versus injection volume line based on the first volume of injection fluid, the first pressure, the number of injection fluid volumes, and the number of pressures includes determining the first slope of the first pressure response versus injection volume line based on the first volume of injection fluid, the first pressure, the number of injection fluid volumes, and the number of pressures via linear regression; and determining a second slope of a second pressure response versus injection volume line based on the second volume of injection fluid, the second pressure, the first volume of injection fluid, the first pressure, the number of injection fluid volumes, and the number of pressures includes determining the second slope of a second pressure response versus injection volume line based on the second volume of injection fluid, the second pressure, the first volume of injection fluid, the first pressure, the number of injection fluid volumes, and the number of pressures via linear regression.

Another innovative aspect of the subject matter described here can be implemented as a well system. The well system includes an injection subsystem including a pumping unit for pumping injection fluid into a closed wellbore in a subterranean region; and data processing apparatus operable to: receive a number of pressures measured at a corresponding number of injection fluid volumes pumped into the closed wellbore in the subterranean region; determine a base slope of a change in the pressure in the wellbore with respect to a change in the number of injection fluid volumes, wherein the base slope represents a linear increase in pressure in the wellbore in response to continued pumping of injection fluid into the wellbore; after receiving the number of pressures at the corresponding number of injection fluid volumes, receive a first pressure in the wellbore in response to a first volume of injection fluid pumped into the wellbore after pumping the number of injection fluid volumes; determine a first slope of a first pressure response versus injection volume line based on the first volume of injection fluid, the first pressure, the number of injection fluid volumes and the number of pressures; determine that a first variance between the first slope and the base slope is larger than a first threshold; receive a second pressure in the wellbore in response to a second volume of injection fluid pumped into the wellbore after pumping the first injection fluid volume; determine a second slope of a second pressure response versus injection volume line based on the second volume of injection fluid, the second pressure, the first volume of injection fluid, the first pressure, the number of injection fluid volumes and the number of pressures; determine that a second variance between the second slope and the first slope is larger than a second threshold; and in response to determining that both the first difference is larger than the first threshold and the second variance is larger than the second threshold, send an instruction to stop the pumping unit from pumping additional injection fluid into the closed wellbore in the subterranean region.

This, and other aspects, can include one or more of the following features. In some aspects, the pumping unit is operable to, in response to receive the instruction, stop pumping; and open well valves to bleed off the pressure in the wellbore.

In some aspects, the data processing apparatus is further operable to determine a leak-off pressure based on the second pressure.

In some aspects, the first threshold and the second threshold are determined based on empirical leak off test data.

In some aspects, the first pressure includes a first surface pumping pressure of the closed wellbore; and the second pressure includes a second surface pumping pressure of the closed wellbore.

In some aspects, the first volume of injection fluid pumped into the wellbore is different from the second volume of injection fluid pumped into the wellbore.

In some aspects, the data processing apparatus is operable to: determine the first slope of the first pressure response versus injection volume line based on the first volume of injection fluid, the first pressure, the number of injection fluid volumes and the number of pressures via linear regression; and determine the second slope of a second pressure response versus injection volume line based on the second volume of injection fluid, the second pressure, the first volume of injection fluid, the first pressure, the number of injection fluid volumes and the number of pressures via linear regression.

While generally described as computer-implemented software embodied on tangible media that processes and transforms the respective data, some or all of the aspects may be computer-implemented methods or further included in respective systems or other devices for performing this described functionality. The details of these and other aspects and implementations of the present disclosure are set forth in the accompanying drawings and the description below. Other features and advantages of the disclosure will be apparent from the description and drawings, and from the claims.

BRIEF DESCRIPTION OF THE DRAWINGS

Like reference numbers and designations in the various drawings indicate like elements.

DETAILED DESCRIPTION

Leak-off tests (LOTs) typically rely on manual judgment to determine when the maximum pressure has reached and whether to continue or stop pumping to further increase the wellbore pressure. This disclosure describes computer-implemented methods, software, and systems for automatic pumping control for a LOT of a subterranean region. For example, a pumping device for performing a LOT of a subterranean region can be controlled automatically to ensure the integrity of a wellbore in which the LOT is performed.

Figure 2:
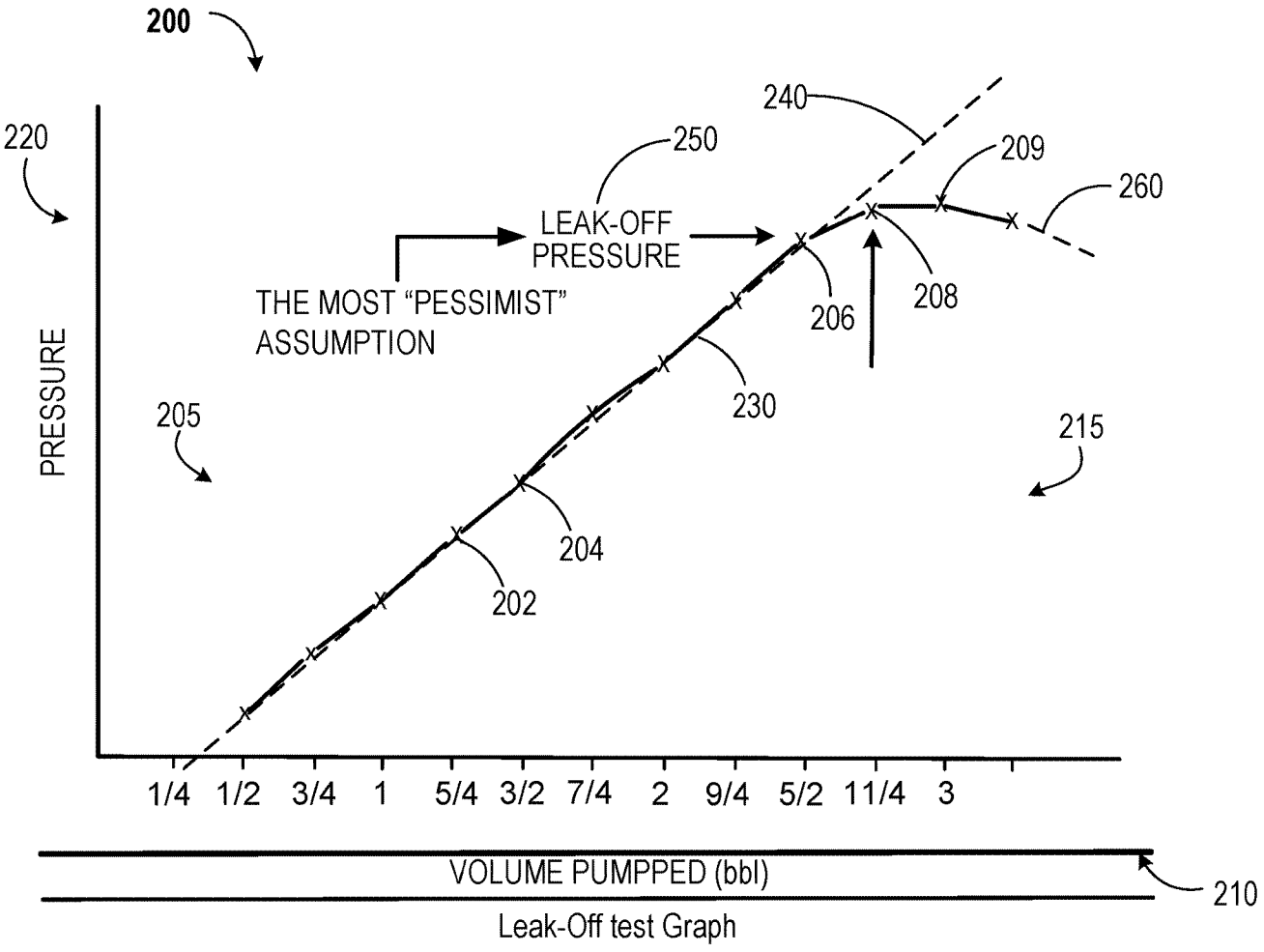
FIG. 2 is a plot showing an example LOT graph.

During the construction of wellbores in a subterranean region, exact knowledge of the in-situ stresses of the penetrated rock formations is critical for maintaining wellbore integrity. LOT can be performed to measure the minimum horizontal stress ($\sigma_{H,min}$), where fluid is pumped into a closed wellbore, slowly increasing downhole hydrostatic pressure and monitoring the formation response via a pressure/volume (equivalent to stress/strain) diagram (for example, as shown in FIG. 2).

LOTs, however, are typically not performed in development wells (or treatment wells) for fear of, unintentionally, exceeding fracture initiation pressures, permanently damaging the wellbore, and permanently lowering formation breakdown pressures to fracture propagation pressure (FPP) levels. Instead, formation integrity tests (FITs) are conducted, where pumping is stopped at a pre-determined maximum pressure to confirm that the subsequent wellbore section will be able to withstand planned mud densities. But FITs fall short to provide useful in-situ formation stress data or any absolute limit of applicable mud weights in case of unexpected well control situations.

Example techniques are described in this disclosure that can automatically control pumping during the execution of LOTs and avoid unintentional formation breakdown. The example techniques can be implemented, for example, by installing one or more automatic high-pressure pump controllers (programmable logic controller (PLC)-based) that automatically track the pressure/volume trend during execution of LOTs and shut off the pumps at a first confirmed indication of breakover from elastic to plastic rock behavior (that is, when a leak-off occurs). An indication of plastic formation behavior includes, for example, a deviation of the monitored relationship between wellbore pressure and cumulative volume pumped (referred to as a pressure/volume relationship) from a straight-line, linear pressure/volume relationship. In some implementations, the controller software can identify the first confirmed indication of breakover from elastic to plastic rock behavior, for example, based on analysis of slopes of the monitored pressure/volume relationship. Accordingly, incorporating such an automatic pump controller can enable automatic identification of the leak-off pressure, and mitigate or eliminate any danger of continuing pumping resulting in unintentionally exceeding the fracture initiation pressure (FIP).

In some implementations, the techniques described herein can allow LOTs, replacing the typical FITs, to be performed as a part of daily operations, while substantially guaranteeing wellbore integrity (for example, including wellbore stability and well strengthening). The proposed techniques can provide more accurate data (for example, control data on in-situ rock stress conditions across all actual fields) for the development of basin-wide geo-mechanical models. The proposed techniques can provide better understanding of in-situ stresses, substantially reducing lost-circulation problems which account for a majority of Drilling & Workover's lost time. The proposed techniques can provide an automatic and immediate assessment of leak-off pressures. The proposed techniques can provide better control of subsurface stress situations and can also allow optimization of casing design (for example, in terms of casing setting depth) decision criteria.

FIG. 2 is a diagram showing an example leak-off test graph 200. The leak-off test graph 200 represents a formation response, particularly, a pressure response to a LOT performed in a subterranean region. The leak-off test graph 200 includes an x-axis 210 representing a cumulative volume of injection fluid pumped into a closed wellbore, and a y-axis 220 representing a wellbore pressure in response to the cumulative injection fluid volumes. The leak-offtest graph 200 includes example data points 202, 204, 206, 208, and 209 representing multiple measured wellbore pressures at respective cumulative injection fluid volumes. The data points can be measured, for example, at every ¼, ½, or another number of bbl of volume injected into the closed wellbore, or at another frequency.

Figure 1:
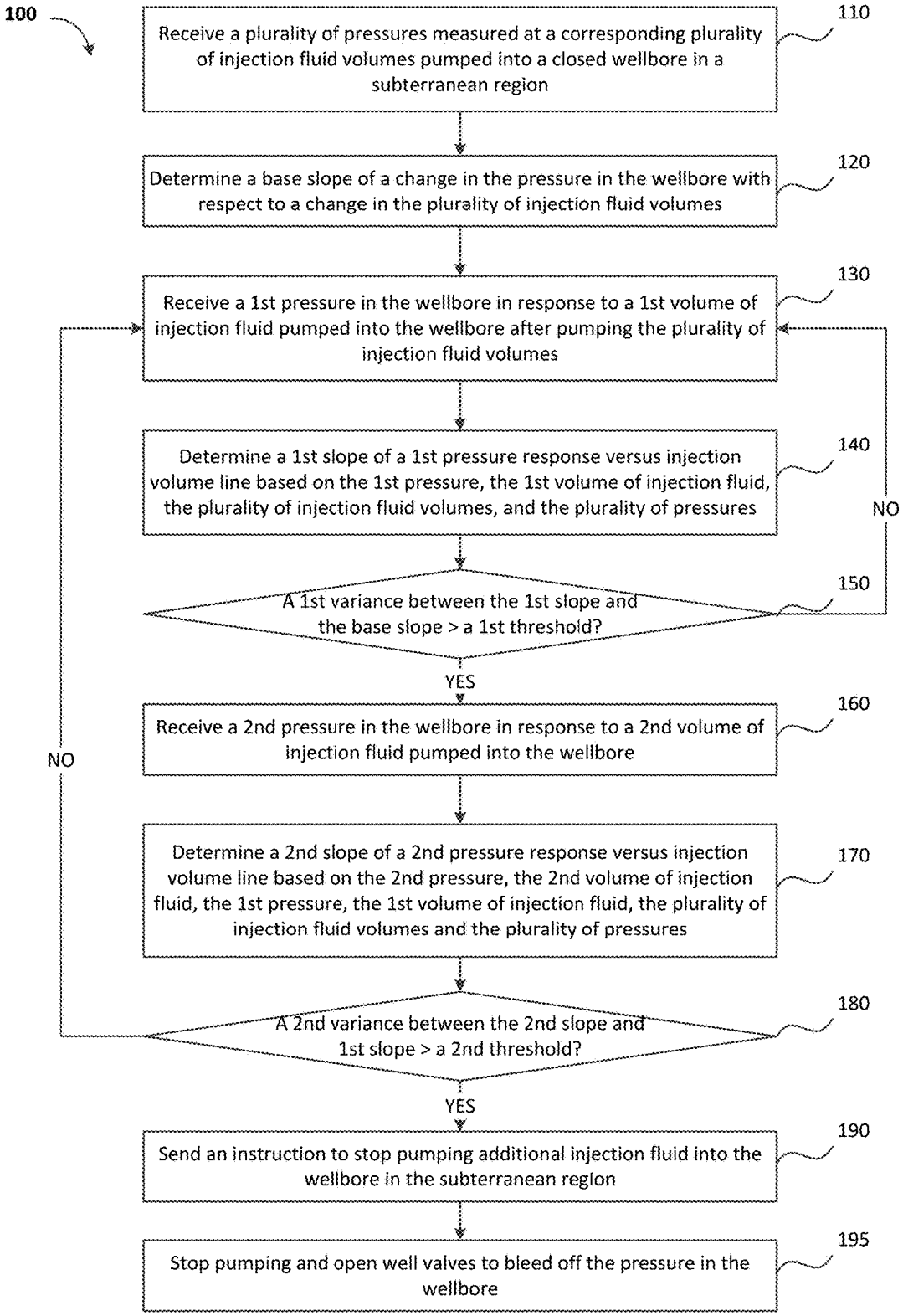
FIG. 1 is a flow chart showing an example method of automatic pumping control for performing a leak-off test (LOT) of a subterranean region.

FIG. 1 is a flow chart showing an example method 100 of automatic pumping control for performing a leak-off test (LOT) of a subterranean region. The example method 100 includes steps 110, 120, 130, 140, 150, 160, 170, 180, 190 and 195. Such steps are described as shown in FIG. 1.

In some implementations, based on the data points (for example, the example data points 202, 204, 206, 208, and 209), the relationship between the wellbore pressure 220 and cumulative volume pumped 210 (referred to as a pressure/volume relationship) can be represented by a line (the term "line" is broad enough to encompass a straight line, a curve, or other two-dimensional representations). For example, the pressure/volume relationship can be represented by a pressure/volume line 230 via regression or other data analysis techniques based on the data points. In some implementations, as long as the wellbore behaves like a closed vessel (that is, the formation is only deformed elastically, and no additional wellbore volume is created via fractures), the pressure/volume relationship between the wellbore pressure 220 and volume pumped 210 is generally linear. The linear relationship can be identified by a slope of the pressure/volume line 230, for example, via linear regression, based on initial data points that are obtained during the beginning pumping/injection phase of a LOT. These initial data points (for example, data points 202 and 204) are known or presumed to fall into an elastic region 205. As illustrated in FIG. 2, the pressure/volume line 230 has a linear relationship in the elastic region 205, which is represented by a straight line 240 having a first slope.

As pumping the injection fluid continues during the LOT, first microfractures can be created that effectively increase the wellbore volume. For example, the data point 206 represents a point at which the leak-off occurs. The data point 206 represents where the leak-off occurs. In some implementations, the leak-off point can be identified as the last data point that lies in the straight line 240 or falls within the elastic region 205. The pressure associated with the data point 206 represents a leak-off pressure 250, which can be determined by identifying the corresponding pressure (that is, the y-axis coordinate) of the leak-off point 206.

When the leak-off occurs, a breakover occurs from elastic to plastic formation deformation. In the leak-off test graph 200, data points subsequent to the data point 206 fall into a plastic region 215 and the breakover can be reflected by a deviation from the linear relationship represented by the straight line 240 (see the portion of the pressure/volume line 230 to the right side of the data point 206). For example, data point 208 is the first measured data point that deviates from the general linear trend, and data point 209 is the second data point that deviates from the general linear trend. Once fracture initiation pressure (FIP) is reached, for example, by pumping further volume, a fracture opens (typically perpendicular to the orientation of ($\sigma_{H,min}$) and wellbore pressure drops to fracture propagation pressure (FPP) levels, which can be seen from the end portion 260 of the pressure/volume line 230. Pressures subsequently stabilize at the (lower) formation propagation pressure, and permanent fractures around the wellbore can be created. Generally accepted geomechanics theory stipulates that such fractures normally do not "heal", that is, formation breakdown pressures are reduced from (initial) FIP to (permanent) FPP levels. FIP is the maximum pressure that can be achieved during an LOT. In the leak-off test graph 200, data point 209 is the data point achieving FIP.

To avoid unintentional formation breakdown in LOTs, an adaptive controller can be used to monitor wellbore pressure 220 over the cumulative volume pumped 210 and to detect the deviation from a straight-line trend, indicating the breakover of the formation from the elastic region 205 to a plastic deformation region 225. For example, the controller software can identify the first set of data points (for example, data points 202 and 204) that clearly fall into the elastic region 205, subsequently interpret a second slope of the latest set of three data points (for example, taken every ¼, ½, or another number of bbl of cumulative volume pumped), and compare the second slope against the overall linear regression slope (for example, the slope of the pressure/volume line 230 in the elastic region 205, that is, the first slope of the straight line 240). If the difference between the first slope and the second slope exceeds a defined maximum slope change, the controller software can trigger the decision to stop the pump. In other words, as soon as two consecutive data points indicate a deviation from the elastic behavior, the controller software can confirm breakover from elastic to plastic formation behavior. In response to such a determination, the controller can stop pumping automatically. As such, dangers of past fracture initiation pressure can be avoided or eliminated. Using two consecutive data points to confirm the determination can avoid false alarm as a single data point that shows deviation may be attributed to a measurement error or other artifacts. On the other hand, using more than two data points showing deviations to confirm the determination may risk pumping too much volume into the wellbore that causes permanent damages.

Figure 3:
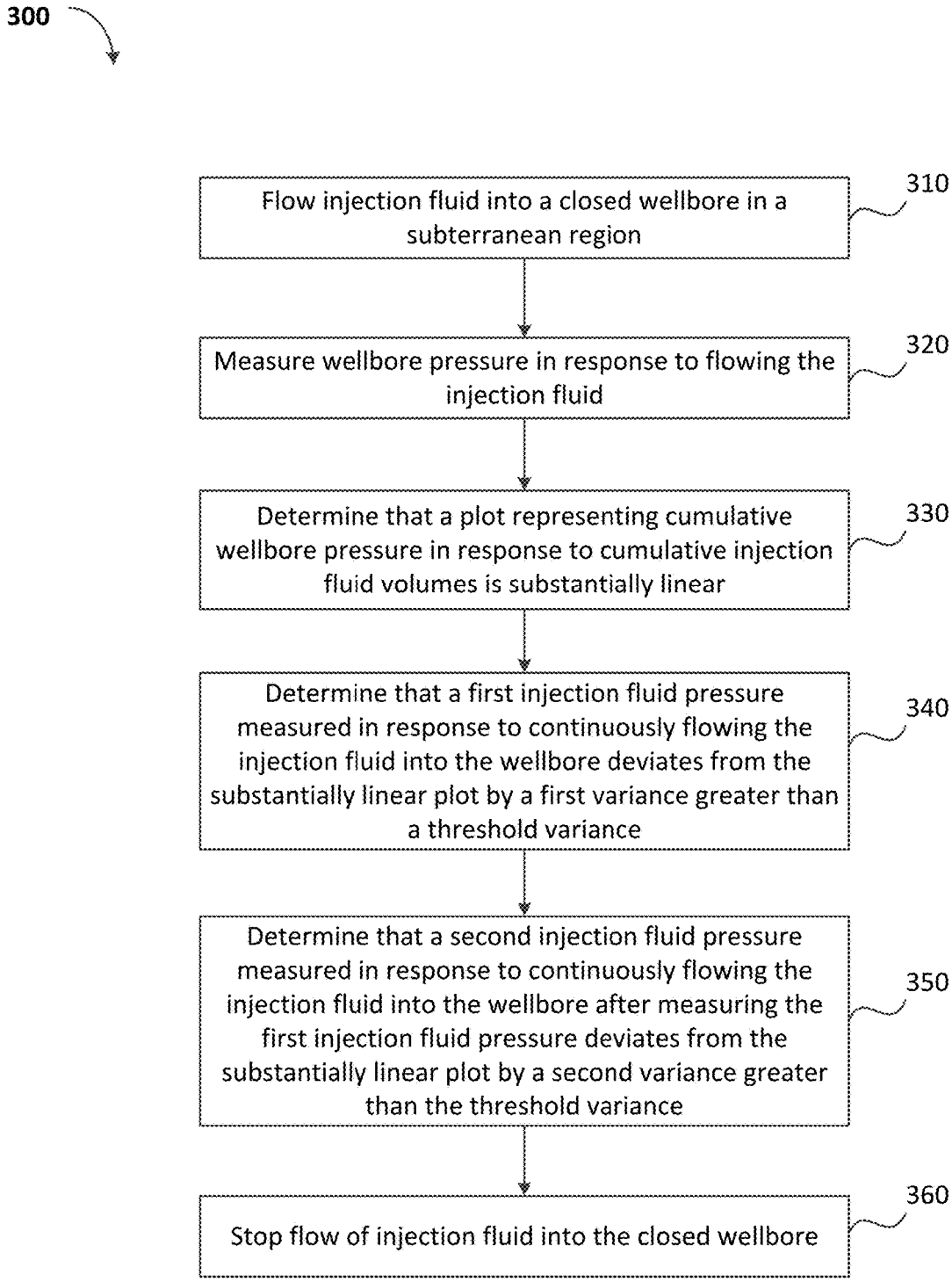
FIG. 3 is a flow chart showing another example method of automatic pumping control for performing a LOT of a subterranean region.

FIG. 3 is a flow chart showing another example process 300 for automatically controlling a pumping device for performing a LOT of a subterranean region. The process 300 can be implemented, for example, by a well system (for example, the well system 400 in FIG. 4).

At 310, injection fluid is injected, pumped, or flowed into a closed wellbore in a subterranean region. For example, the injection fluid can be injected by an injection system (for example, the injection subsystem 420 in FIG. 4) into a closed wellbore (for example, the wellbore 404 in FIG. 4) in a subterranean region.

At 320, wellbore pressure in response to flowing the injection fluid into the closed wellbore is measured, for example, taken at the pump units of an injection system. The wellbore pressure can be measured in real time (or substantially in real time) during the LOT. The wellbore pressure can correspond to a given cumulative volume of the injection fluid that is pumped into the wellbore during the LOT. Each wellbore pressure corresponding to a respective given cumulative injection volume can be, for example, represented by a data point, as a part of pressure response data. The pressure data can be collected and transmitted to data processing apparatus (one or more processor(s) of a PLC controller). In some implementations, the wellbore pressure can be stored in data storage device.

At 330, it can be determined that a plot representing a wellbore pressure in response to cumulative injection fluid volumes is substantially linear. The plot can be generated based on the pressure response data. For example, during the LOT, as pumping the injection fluid into the wellbore continues, data points that represent the wellbore pressure in response to the increase of the fluid volume can be received, for example, by a controller or another data processing apparatus. The plot can be generated or updated upon receiving the pressure response data in real time (or substantially in real time), for example, based on regression, fitting, or other data analysis techniques. The plot can include, for example, the pressure/volume line 230 in FIG. 2. In some implementations, it can be determined that the plot is substantially linear, for example, based on the slope of the plot and its variance, the confidence level of the fitting, and other statistics of the data analysis techniques for generating the plot.

At 340, after determining that the plot is linear, it can be determined that a first injection fluid pressure measured in response to flowing the injection fluid into the wellbore deviates from the substantially linear plot by a first variance greater than a threshold variance. In some implementations, such a determination can include determining a first regression line computed based on the first injection fluid pressure measured in response to flowing the injection fluid into the wellbore; and determining that the first regression line deviates from the substantially linear plot by the first variance greater than a threshold variance. In some implementations, the first injection fluid pressure can be, for example, a first surface pumping pressure of the closed wellbore. The first regression line can be computed, for example, via linear regression or other regression techniques based on the first injection fluid pressure and one or more injection fluid pressures measured before flowing the injection fluid into the wellbore. The first variance can be, for example, a variance in slopes between the first regression line and the substantially linear plot. The LOT can continue despite this deviation from linearity.

At 350, it can be determined that a second injection fluid pressure, measured in response to flowing the injection fluid into the wellbore after measuring the first injection fluid pressure, deviates from the substantially linear plot by a second variance greater than the threshold variance. Similarly, in some implementations, such a determination can include determining a second regression line computed based on the second injection fluid pressure measured after measuring the first injection fluid pressure, and determining that the second regression line deviates from the substantially linear plot by the second variance greater than the threshold variance. The second injection fluid pressure can be, for example, a second surface pumping pressure of the closed wellbore. The second regression line can be computed, for example, via linear regression or other regression techniques based on the second injection fluid pressure and one or more injection fluid pressures measured before measuring the second injection fluid pressure. For instance, the one or more injection fluid pressures measured before measuring the second injection fluid pressure can include the first injection fluid pressure measured in response to flowing the injection fluid into the wellbore. The second variance can be, for example, a variance in slopes between the second regression line and the substantially linear plot. The threshold variance for the first variance can be the same as or different from that for the second variance.

At 360, in response to determining that the first injection fluid pressure deviates from the substantially linear plot by the first variance greater than a threshold variance and determining that the second injection fluid pressure deviates from the substantially linear plot by the second variance greater than the threshold variance, flow of injection fluid into the closed wellbore can be stopped. For example, a controller (for example, a PLC controller installed on one or more pumping units) can shut off the pumping units of the injection treatment subsystem to stop the flow of injection fluid into the closed wellbore.

Figure 4:
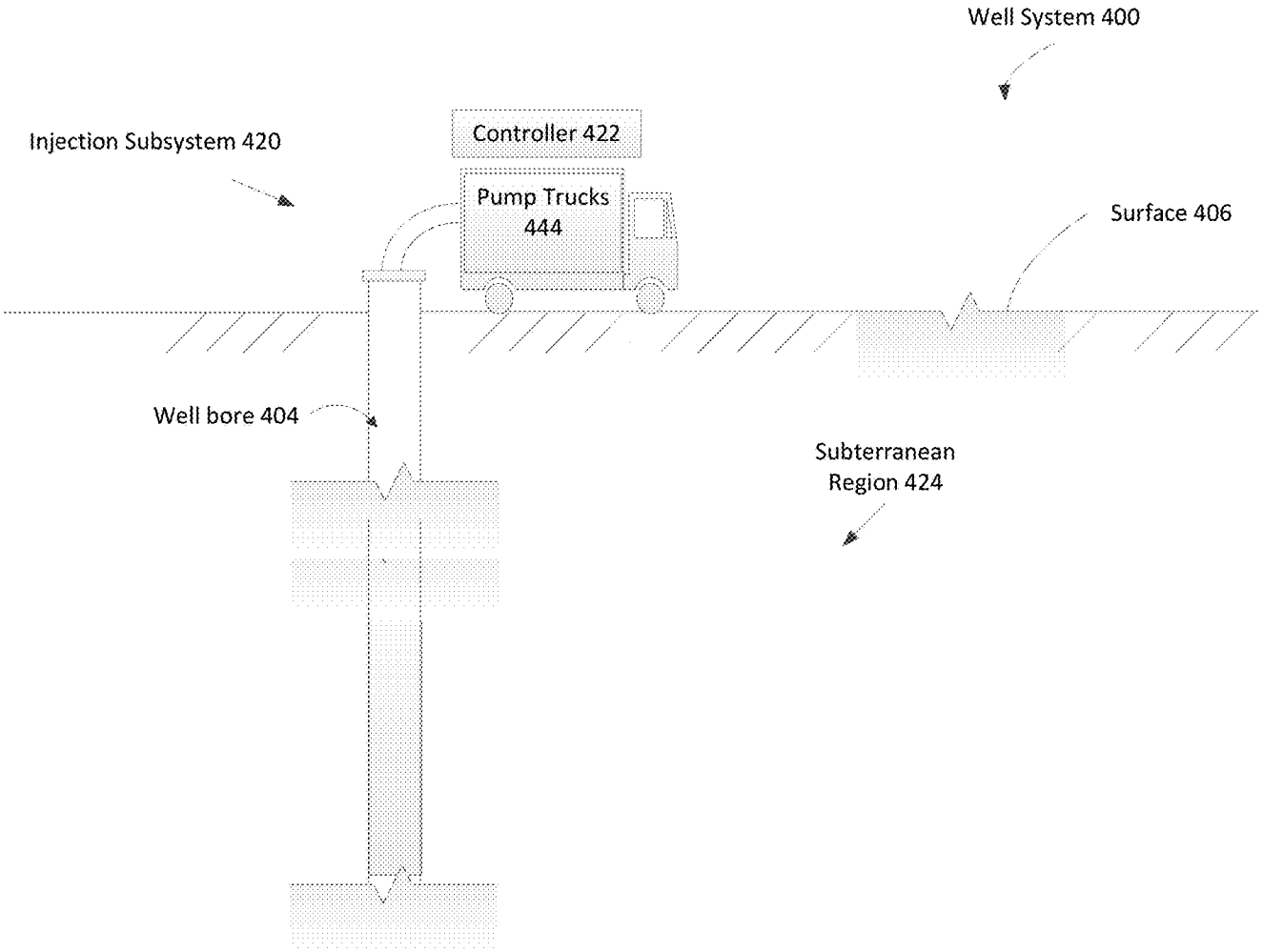
FIG. 4 is a diagram showing an example well survey system.

FIG. 4 shows a schematic diagram of an example well system 400. The example well system 400 can be used, for example, to perform LOTs for reservoir analysis of a subterranean region 424. The example well system 400 includes a wellbore 404 in the subterranean region 424 beneath the surface 406. One or more LOTs can be performed in the wellbore 404, for example, by an injection subsystem 420. The injection subsystem 420 includes instrument trucks 446, pump trucks 444, and other equipment. The injection subsystem 420 can apply an injection test or treatment to the subterranean region 424 through the wellbore 404. The injection treatment can be a LOT, a FIT, or any other tests. For example, the LOT can shut in the wellbore 404 and pump injection fluid into the wellbore 404 to gradually increase the pressure that the formation experiences. At some pressure, the injection fluid can enter the formation or leak off, either moving through permeable paths in the rock or by creating a space by fracturing the rock. The injection treatment can be a fracture treatment that fractures the subterranean region 424. For example, the injection treatment may initiate, propagate, or open fractures in the subterranean region 424.

The pump trucks 444 can include one or more pumping devices or units for pumping injection fluid into a wellbore in a subterranean region. For example, the pump trucks 444 may include mobile vehicles, immobile installations, skids, hoses, tubes, fluid tanks or reservoirs, pumps, valves, or other suitable structures and equipment. In some cases, the pump trucks 444 are coupled to a working string disposed in the wellbore 404. During operation, the pump trucks 444 can pump fluid through the working string and into the subterranean region 424. The pumped fluid can include a pad, proppants, a flush fluid, additives, or other materials.

In some implementations, an injection test or treatment can be controlled by an injection control system. For example, the injection control system can include a controller 422 for automatic pumping control during a LOT. For example, an automatic controller can be installed for high-pressure pumping units that perform LOT. In some implementations, the controller 422 can be installed on the pump truck 444 and perform automatic control during the LOT based on the volume/pressure measurements taken right there from the pumping units.

The controller 422 can be, for example, a PLC-based controller that includes a computer. The computer can include software, hardware, firmware, or a combination of them. In some implementations, the controller 422 can include a data processing apparatus (for example, one or more processors), a computer-readable medium (for example, a memory), and communication interfaces (for example, input/output controllers and network interfaces). The controller 422 can perform some or all operations described in connection with FIGS. 1-3 individually or in collaborations with other components of the well system 400. For example, the perform automatic control can automatically monitor and track the pressure/volume trend during the execution of LOTs and shut off the pumps at a first confirmed indication of breakover of the formation from elastic to plastic rock behavior.

The operations described in this disclosure can be implemented as operations performed by a data processing apparatus on data stored on one or more computer-readable storage devices or received from other sources. The term "data processing apparatus" encompasses all kinds of apparatus, devices, and machines for processing data, including by way of example a programmable processor, a computer, a system on a chip, or multiple ones, or combinations of the foregoing. The apparatus can include special purpose logic circuitry, for example, a FPGA (field programmable gate array) or an ASIC (application-specific integrated circuit). The apparatus can also include, in addition to hardware, code that creates an execution environment for the computer program in question, for example, code that constitutes processor firmware, a protocol stack, a database management system, an operating system, a cross-platform runtime environment, a virtual machine, or a combination of one or more of them.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A method of performing a leak off test for reservoir analysis, the method comprising:

receiving, by operation of data processing apparatus coupled to a non-transitory computer-readable storage medium for storing a computer program for execution by the data processing apparatus, a plurality of pressures measured at a corresponding plurality of injection fluid volumes pumped into a closed wellbore in a subterranean region;

determining, by operation of the data processing apparatus, a base slope of a change in the pressure in the wellbore with respect to a change in the plurality of injection fluid volumes, wherein the base slope represents a linear increase in pressure in the wellbore in response to continued pumping of injection fluid into the wellbore;

after receiving the plurality of pressures at the corresponding plurality of injection fluid volumes, receiving, by operation of the data processing apparatus, a first pressure in the wellbore in response to a first volume of injection fluid pumped into the wellbore after pumping the plurality of injection fluid volumes;

determining, by operation of the data processing apparatus, a first slope of a first pressure response versus injection volume line based on the first volume of injection fluid, the first pressure, the plurality of injection fluid volumes and the corresponding plurality of pressures via linear regression, such linear regression performed with a first data set including the first volume of injection fluid, the first pressure, the plurality of injection pressures and the corresponding plurality of pressures;

determining, by operation of the data processing apparatus, that a first variance between the first slope and the base slope is larger than a first threshold;

receiving, by operation of the data processing apparatus, a second pressure in the wellbore in response to a second volume of injection fluid pumped into the wellbore after pumping the first volume of injection fluid, wherein the second pressure is a next pressure measured consecutively to the first pressure;

determining, by operation of the data processing apparatus, a second slope of a second pressure response versus injection volume line based on the second volume of injection fluid, the second pressure, the first volume of injection fluid, the first pressure, the plurality of injection fluid volumes and the corresponding plurality of pressures via linear regression, such linear regression performed with a second data set including the second volume of injection fluid, the second pressure, the first volume of injection fluid, the first pressure, the plurality of injection fluid volumes and the corresponding plurality of pressures;

determining, by operation of the data processing apparatus, that a second variance between the second slope and the first slope is larger than a second threshold;

in response to determining that both the first difference is larger than the first threshold and the second variance is larger than the second threshold, determining, automatically by operation of the data processing apparatus, to stop flow of injection fluid into the closed wellbore without waiting for ensuring pressures measured in response to additional injection fluid pumped in the wellbore; and in response to determining to stop flow of injection fluid into the closed wellbore without waiting for ensuring injection fluid pressures, sending, by operation of the data processing apparatus, an instruction to stop pumping additional injection fluid into the closed wellbore in the subterranean region.

2. The method of claim 1, further comprising:

stopping pumping; and opening well valves to bleed off the pressure in the wellbore.

3. The method of claim 1, further comprising determining a leak-off pressure based on the second pressure.

4. The method of claim 1, wherein the first threshold and the second threshold are determined based on empirical leak off test data.

5. The method of claim 1, wherein:

the first pressure comprises a first surface pumping pressure of the closed wellbore; and the second pressure comprises a second surface pumping pressure of the closed wellbore.

6. The method of claim 1, wherein the first volume of injection fluid pumped into the wellbore is different from the second volume of injection fluid pumped into the wellbore.

7. A well system comprising:

an injection subsystem including a pumping unit for pumping injection fluid into a closed wellbore in a subterranean region;

data processing apparatus; and a non-transitory computer-readable storage medium coupled to the data processing apparatus and storing a computer program for execution by the data processing apparatus, the computer program instructing the data processing apparatus to:

receive a plurality of pressures measured at a corresponding plurality of injection fluid volumes pumped into the closed wellbore in the subterranean region;

determine a base slope of a change in the pressure in the wellbore with respect to a change in the plurality of injection fluid volumes, wherein the base slope represents a linear increase in pressure in the wellbore in response to continued pumping of injection fluid into the wellbore;

after receiving the plurality of pressures at the corresponding plurality of injection fluid volumes, receive a first pressure in the wellbore in response to a first volume of injection fluid pumped into the wellbore after pumping the plurality of injection fluid volumes;

determine a first slope of a first pressure response versus injection volume line based on the first volume of injection fluid, the first pressure, the plurality of injection fluid volumes and the corresponding plurality of pressures via linear regression, such linear regression performed with a first data set including the first volume of injection fluid, the first pressure, the plurality of injection pressures and the corresponding plurality of pressures;

determine that a first variance between the first slope and the base slope is larger than a first threshold;

receive a second pressure in the wellbore in response to a second volume of injection fluid pumped into the wellbore after pumping the first volume of injection fluid, wherein the second pressure is a next pressure measured consecutively to the first pressure;

determine a second slope of a second pressure response versus injection volume line based on the second volume of injection fluid, the second pressure, the first volume of injection fluid, the first pressure, the plurality of injection fluid volumes and the corresponding plurality of pressures via linear regression, such linear regression performed with a second data set including the second volume of injection fluid, the second pressure, the first volume of injection fluid, the first pressure, the plurality of injection fluid volumes and the corresponding plurality of pressures;

determine that a second variance between the second slope and the first slope is larger than a second threshold; and in response to determining that both the first difference is larger than the first threshold and the second variance is larger than the second threshold, automatically determine to stop flow of injection fluid into the closed wellbore without waiting for ensuring pressures measured in response to additional injection fluid pumped in the wellbore; and in response to determining to stop flow of injection fluid into the closed wellbore without waiting for ensuring injection fluid pressures, send an instruction to stop the pumping unit from pumping additional injection fluid into the closed wellbore in the subterranean region.

8. The system of claim 7, wherein the pumping unit is operable to, in response to receive the instruction:

stop pumping; and open well valves to bleed off the pressure in the wellbore.

9. The system of claim 7, wherein the computer program further instructs the data processing apparatus to determine a leak-off pressure based on the second pressure.

10. The system of claim 7, wherein the first threshold and the second threshold are determined based on empirical leak off test data.

11. The system of claim 7, wherein:

the first pressure comprises a first surface pumping pressure of the closed wellbore; and the second pressure comprises a second surface pumping pressure of the closed wellbore.

12. The system of claim 7, wherein the first volume of injection fluid pumped into the wellbore is different from the second volume of injection fluid pumped into the wellbore.

13. A non-transitory computer-readable storage medium coupled to data processing apparatus and storing a computer program for execution by the data processing apparatus to perform operations comprising:

receiving a plurality of pressures measured at a corresponding plurality of injection fluid volumes pumped by an injection system into a closed wellbore in a subterranean region;

determining a base slope of a change in the pressure in the wellbore with respect to a change in the plurality of injection fluid volumes, wherein the base slope represents a linear increase in pressure in the wellbore in response to continued pumping of injection fluid into the wellbore;

after receiving the plurality of pressures at the corresponding plurality of injection fluid volumes, receiving a first pressure in the wellbore in response to a first volume of injection fluid pumped into the wellbore after pumping the plurality of injection fluid volumes;

determining a first slope of a first pressure response versus injection volume line based on the first volume of injection fluid, the first pressure, the plurality of injection fluid volumes and the corresponding plurality of pressures via linear regression, such linear regression performed with a first data set including the first volume of injection fluid, the first pressure, the plurality of injection pressures and the corresponding plurality of pressures;

determining that a first variance between the first slope and the base slope is larger than a first threshold;

receiving a second pressure in the wellbore in response to a second volume of injection fluid pumped into the wellbore after pumping the first volume of injection fluid, wherein the second pressure is a next pressure measured consecutively to the first pressure;

determining a second slope of a second pressure response versus injection volume line based on the second volume of injection fluid, the second pressure, the first volume of injection fluid, the first pressure, the plurality of injection fluid volumes and the corresponding plurality of pressures via linear regression, such linear regression performed with a second data set including the second volume of injection fluid, the second pressure, the first volume of injection fluid, the first pressure, the plurality of injection fluid volumes and the corresponding plurality of pressures;

determining that a second variance between the second slope and the first slope is larger than a second threshold;

in response to determining that both the first difference is larger than the first threshold and the second variance is larger than the second threshold, automatically determining to stop flow of injection fluid into the closed wellbore without waiting for ensuring pressures measured in response to additional injection fluid pumped in the wellbore; and in response to determining to stop flow of injection fluid into the closed wellbore without waiting for ensuring injection fluid pressures, sending an instruction to stop pumping additional injection fluid into the closed wellbore in the subterranean region.

14. The non-transitory computer-readable storage medium of claim 13, wherein the operations further comprise sending instructions to the injection system to:

stop pumping; and open well valves to bleed off the pressure in the wellbore.

15. The non-transitory computer-readable storage medium of claim 13, wherein the operations further comprise determining a leak-off pressure based on the second pressure.

16. The non-transitory computer-readable storage medium of claim 13, wherein the first threshold and the second threshold are determined based on empirical leak off test data.

17. The non-transitory computer-readable storage medium of claim 13, wherein:

the first pressure comprises a first surface pumping pressure of the closed wellbore; and the second pressure comprises a second surface pumping pressure of the closed wellbore.

18. The non-transitory computer-readable storage medium of claim 13, wherein the first volume of injection fluid pumped into the wellbore is different from the second volume of injection fluid pumped into the wellbore.

* * * * *